US005218358A

United States Patent [19]

Harrington et al.

[11] Patent Number: 5,218,358

[45] Date of Patent: Jun. 8, 1993

[54] LOW COST ARCHITECTURE FOR FERRIMAGNETIC ANTENNA/PHASE SHIFTER

[75] Inventors: William A. Harrington, Whittier; James V. Strahan, Brea, both of Calif.

[73] Assignee: Hughes Aircraft Company, Los Angeles, Calif.

[21] Appl. No.: 841,393

[22] Filed: Feb. 25, 1992

[51] Int. Cl.[5] ..... H01Q 3/36

[52] U.S. Cl. ..... 342/372; 342/157

[58] Field of Search ..... 342/157, 372

[56] References Cited

U.S. PATENT DOCUMENTS

| | | | |
|---|---|---|---|
| H173 | 12/1986 | Claborn et al. | 342/372 |
| 3,906,502 | 9/1975 | Connolly | 342/372 |
| 4,450,448 | 5/1984 | Albanese et al. | 342/372 X |
| 5,079,557 | 1/1992 | Hopwood et al. | 342/372 X |

*Primary Examiner*—T. H. Tubbesing

*Attorney, Agent, or Firm*—Wanda K. Denson-Low

[57] ABSTRACT

A phase shifter assembly for use with a phased array antenna includes a plurality of phase shifter subarrays which are mounted on a ferri-magnetic substrate. There is a common power feed which is connected in series through a transmission line with each of the phase shifter subarrays. Additionally, a plurality of power combiners/splitters are connected into the transmission line to direct the proportionate power to each subarray. An alignment phase shifter is connected into the transmission line between adjacent subarrays and their associated power combiner/splitter. Separately from the transmission line, a driver is electronically connected in series with coils at each of the alignment phase shifters to alter the phase power which is fed into each of the subarray to align adjacent subarrays and produce a substantially continuous wave for the antenna. There is also a common driver which is electronically connected in series with each of the phase shifter subarrays to alter the phase of the power which is fed from the common power feed to the radiating elements of the antenna and thereby establish the direction of the radiated beam.

16 Claims, 2 Drawing Sheets

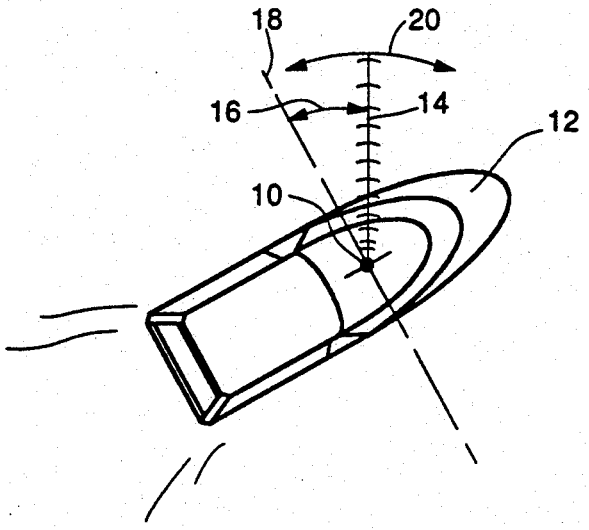
FIG. 1.
FIG. 2
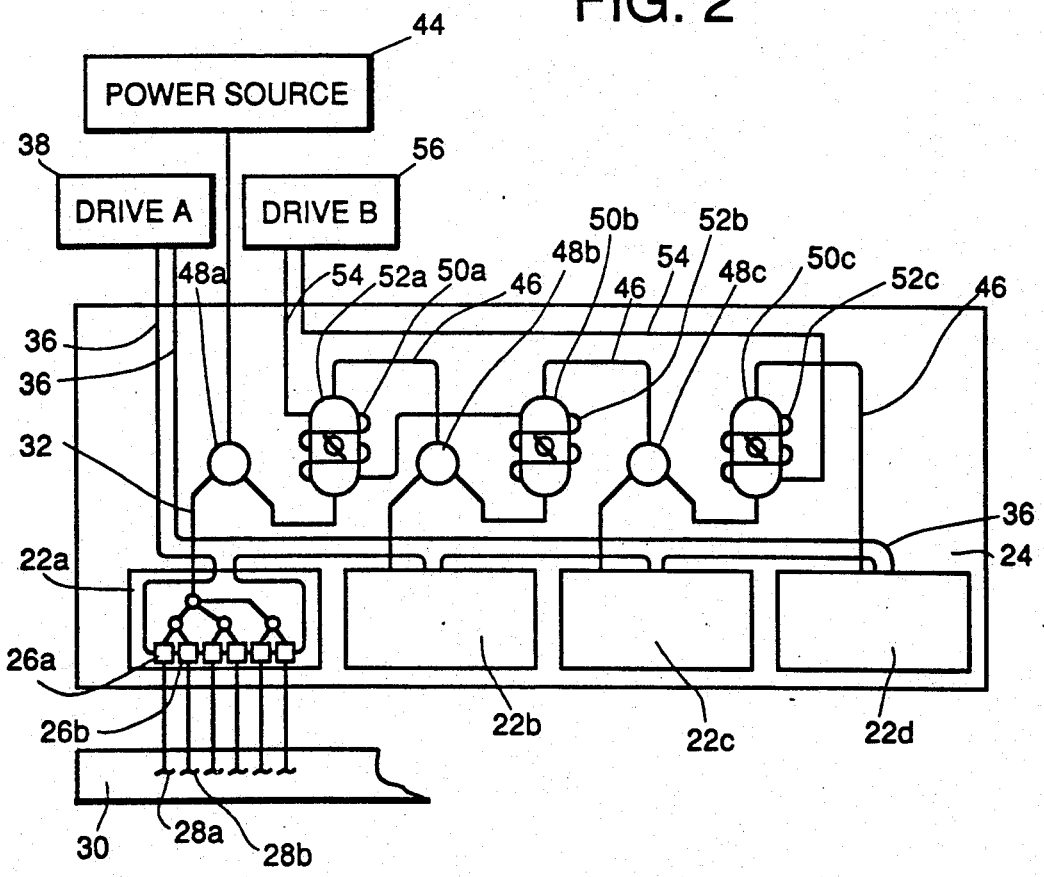

LOW COST ARCHITECTURE FOR FERRIMAGNETIC ANTENNA/PHASE SHIFTER

FIELD OF THE INVENTION

The present invention pertains generally to phased array radars having a plurality of subarrays. More particularly, the present invention pertains to phased array radars which have a common power feed connected in series with each of the phase shifter subarrays, and which have a common driver electronically connected in series with each of the phase shifter subarrays to alter the phase of the power which is fed to the radiating elements and thereby control the direction at which the beam is radiated from the antenna. The present invention is particularly, but not exclusively, useful as a collision avoidance radar for relatively slow moving vehicles.

BACKGROUND OF THE INVENTION

Phased array radars are well known and are widely used in various configurations for target acquisition purposes. In each case, their basic construction has many similarities and invariably includes an antenna consisting of an array of identical radiators. To operate the system, power is fed to these radiators and the direction at which the beam is radiated from the antenna is controlled with electronic means by altering the phase of the power that is fed to each of the individual radiators. Thus, no mechanical movement is necessary to change the direction of the beam.

Due to speed and accuracy requirements, the design for many configurations of a phased array radar have tended to be rather sophisticated. Typically, there is a central power feed, with cascading transmission lines connecting the power feed to each of the radiators. Also there is typically a separate dedicated phase shifter which is incorporated into the particular transmission line for each radiator. One reason for this particular architecture is that it minimizes the additive effect of potential inaccuracies in the phase shifters. As should be expected, however, this architecture can be expensive and can be very difficult to manufacture. This is particularly so where very short wavelengths are to be used due to the fact the sizes for the radar's components must be appropriately scaled to the wavelength.

It happens, however, that there are some applications for phased array antennas wherein very short wavelengths are acceptable, and may even be desirable. Furthermore, for some applications it is possible to sacrifice some accuracy and speed of response time without denigrating overall system performance. For example, consider the collision avoidance problems confronted by relatively slow moving vehicles such as cars, boats, and light aircraft.

In light of the above, it is an object of the present invention to provide a phase shifter assembly for a phased array radar which is effective for use with relatively short wavelengths in applications where there can be some sacrifice in speed and accuracy requirements. It is also an object of the present invention to provide a phase shifter assembly for a phased array radar which uses a common power feed that is serially connected via a transmission line to each of a plurality of phase shifter subarrays through power splitters/combiners which are tailored to provide the exact attenuation per subarray for optimum beam shape. Another object of the present invention is to provide a phase shifter assembly for a phased array radar which uses a common driver to activate a plurality of alignment phase shifters in the power transmission line for aligning adjacent subarrays in the antenna to establish a substantially continuous wave front for the beam which is radiated from the antenna. Yet another object of the present invention is to provide a phase shifter assembly for a phased array radar which uses a common driver to serially activate the individual phase shifter elements in each phase shifter subarray to direct the beam which is radiated from the antenna. Still another object of the present invention is to provide a phase shifter assembly for a phased array radar which is characterized by mechanical simplicity. Another object of the present invention is to provide a phase shifter assembly for a phased array radar which is relatively easy to manufacture, simple to operate and comparatively cost effective.

SUMMARY OF THE INVENTION

A phase shifter assembly for a phased array radar, which is useful to direct a radiated beam from an antenna, includes a ferri-magnetic substrate on which are mounted a plurality of phase shifter subarrays. Each phase shifter subarray in the assembly has a plurality of individual phase shifter elements which are each respectively connected to a radiating element of the antenna. A series of separate coils, one for each phase shifter subarray, are disposed on the substrate to selectively create magnetic flux through the substrate that will differentially influence each of the phase shifter elements in the various subarrays. A common driver is connected in series with these coils of the phase shifter subarrays to establish the direction for the radiated beam.

The phase shifter assembly for the present invention also includes a single common power feed that is serially connected to each of the phase shifter subarrays via a transmission line. Located in series along the transmission line are a plurality of power splitters/combiners which direct a proportionate power to each of the subarrays. Also, there are a plurality of alignment phase shifters which are positioned along the transmission line so that one alignment phase shifter is located between adjacent power splitters/combiners. A plurality of coils are disposed on the substrate, one for each alignment phase shifter, to influence the respective alignment phase shifter with a magnetic flux. A common driver is connected in series with these coils. Together, the string of serially connected alignment phase shifters, and the serially connected power splitters/combiners, are tailored to provide the exact attenuation per subarray that will give optimum beam shape.

To control the direction of the beam during operation of the phased array radar, the phase shifter assembly of the present invention incorporates a microprocessor which uses preprogrammed information concerning desired antenna activity. Signals from this microprocessor are used to appropriately activate both the driver of the phase shifter subarrays, and the driver of the alignment phase shifters in the transmission line. Similarly, the phase shifter assembly of the present invention incorporates another microprocessor which uses information concerning physical variables which affect the assembly to appropriately activate both the driver of the phase shifter subarrays, and the driver of the alignment phase shifters in the transmission line. Signals from this second microprocessor are used to compensate for irregularities in the system.

The novel features of this invention, as well as the invention itself, both as to its structure and its operation will be best understood from the accompanying drawings, taken in conjunction with the accompanying description, in which similar reference characters refer to similar parts, and in which:

BRIEF DESCRIPTION OF THE DRAWINGS

FIG. 1 is a view from above of a boat using a radar system incorporating the phase shifter assembly of the present invention;

FIG. 2 is a schematic diagram of the interaction of the componentry of the present invention;

DESCRIPTION OF PREFERRED EMBODIMENTS

Figure 3:
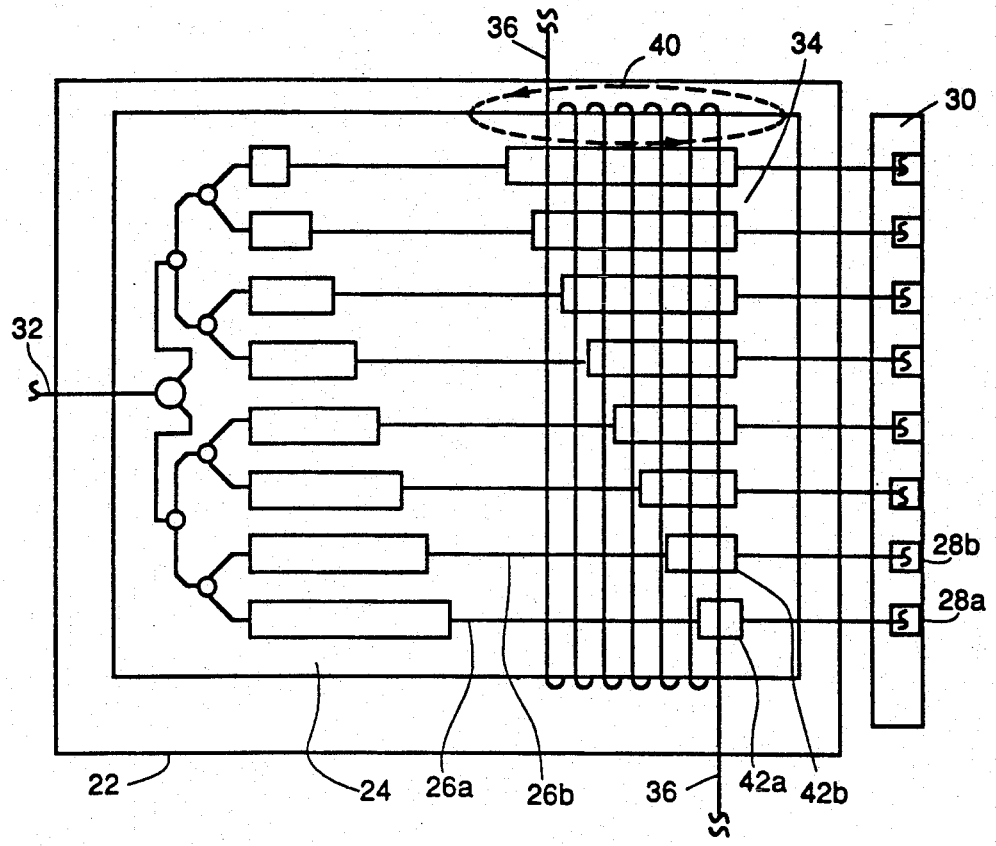
FIG. 3 is a schematic diagram of the electronic componentry of a phase shifter subarray of the present invention.

Referring initially to FIG. 1 a system for a phased array radar is shown in an operational environment and is designated 10. Specifically, as shown, the radar system 10 is being employed on a boat 12 for the purposes of collision avoidance. As will be readily appreciated, boat 12 is only exemplary and any relatively slow moving vehicle, such as a car or a light aircraft, could also benefit from the use of the present invention.

In the operation of the present invention, a beam 14 is radiated by the system 10 and is aimed in a direction indicated by the angle 16. In order to detect targets, and thereby avoid a possible collision, the direction for beam 14, as measured by the angle 16 from a base line 18, is swept back and forth in the directions indicated by the arrow 20. Specifically, in one pass, the beam 14 will sweep through an arc of approximately one hundred and eighty degrees (180°). Additionally, it is intended that the scan time which is required for beam 14 to sweep through this one arc will be on the order of approximately one hundred milliseconds (100 msec). With all this in mind, attention is now focused on the electronic componentry which allows the direction of the beam 14 to be controlled. Specifically, the focus here is on the electronic means which are used for the present invention to coordinate the operation of numerous phase shifters subarrays and thereby control the direction of the beam 14.

Referring now to FIG. 2, it will be seen that the system of the present invention includes a plurality of similar phase shifter subarrays 22 which are mounted on a ferri-magnetic substrate 24. The subarrays 22 a–d are only exemplary, and it is to be appreciated that more than the four subarrays 22 shown in FIG. 2 can be included in radar 10. As shown, each of the subarrays 22 includes a plurality of phase shifter elements 26 which are each individually connected to a separate radiating element 28 of the antenna 30. A complete disclosure of preferred embodiments for a phase shifter subarray 22 to be used with the present invention is set forth in a co-pending application for an invention Ser. No. 07/841,393, filed Feb. 25, 1992, entitled "Single Element Driver Architecture for Ferrite Based Phase Shifter", which is assigned to the assignee of the present invention. Nevertheless, because there are aspects of the individual phase shifter subarrays 22 which are of particular importance to the present invention, the essentials of these aspects are presented in FIG. 3.

For the particular subarray 22 shown in FIG. 3, and thus for all other subarrays 22 since they are substantially similar, it is seen that a plurality of phase shifter elements 26*a* et. seq. are mounted substantially parallel to each other on the substrate 24. Power, from a power feed 32, is fed to each of the phase shifter elements 26 where the phase in the power is altered in a predetermined manner to direct the beam 14. Also, it will be seen that a coil 34 is formed by an electrical line 36 which is wound around part of the substrate 24 and around those portions of the elements 26 which are mounted on this part of the substrate 24. This electrical line 36 is connected to a Drive (A) 38 which is activated in accordance with preprogrammed instructions to pass an electrical current through the line 36. As is well known in the pertinent art, whenever current is passed through the electrical line 36, a flux field 40 will be generated in the particular portion of substrate 24 that is influenced by the coil 34. As is also well known, a magnetic flux field can be used to change the apparent length of a phase shifter element 26 and, thus, alter the phase of the power passing through the phase shifter element 26. In light of the above, by subjecting different lengthed portions 42 of the various phase shifter elements 26 to the same flux field 40, the subarray 22 will differentially shift the phases in the power passing through each element 26. Through this mechanism, the direction of beam 14 is controlled. The key is that the power phase at each radiator 28 must be such that the beam 14 is properly directed and this requires different phases. For example, in FIG. 3 the portion 42*a* of phase shifter element 26*a* is shorter than the corresponding portion 42*b* of phase shifter element 26*b*. It follows that since only the portion 42*a* of phase shifter element 26*a* is subjected to flux field 40 and, similarly, since only the portion 42*b* of phase shifter element 26*b* is subjected to flux field 40, the shift in phase of power passing through element 26*a* will be different than the shift in phase of power passing through element 26*b*. This notion is, of course, applicable to each of the different phase shifter elements 26 in the subarray 22*a* and, further, it applies to each of the different subarrays 22.

Also of importance to the present invention is the fact that power is fed serially to each of the subarrays 22. As shown in FIG. 2, a power source 44 is directly connected to a transmission line 46 and a plurality of power splitters/combiners 48 are connected into the line 46. For purposes of the present invention the power splitters/combiners 48 are of any type well known in the pertinent art. Importantly, however, these power splitters/combiners 48 are connected in series, and each power splitter/combiner 48 is tailor designed to divert a proportionate amount of power to its associated subarray 22. Within this scheme, the power splitter/combiner 48*a* diverts power from transmission line 46 to the subarray 22*a*. Next the power splitter/combiner 48*b* diverts power from the transmission 46 to the subarray 22*b*, and so on. Although FIG. 2 shows only the four subarrays 22, it is to be understood that more subarrays 22 can be connected into series with those shown.

FIG. 2 also shows that a plurality of alignment phase shifters 50 a–c and also connected in series along the transmission line 46. More specifically, each alignment phase shifter 50 is positioned on transmission line 46 between adjacent power splitters/combiners 48. Thus, for example, the alignment phase shifter 52*a* is positioned between the power splitters/combiners 48*a* and 48*b*. As so positioned, this alignment phase shifter 50*a* is able to alter the phase of the power which is passed from transmission line 46, and through the power splitter/combiner 48*b*, to the subarray 22*b*. By properly controlling the phase shift which is imparted at alignment phase shifter 52*a*, the power in beam 14 which is attributable to the subarray 22*b* can be brought into line with the power in beam 14 which is attributable to the subarray 22*a*. With this alignment, a continuous wave can be generated from the subarrays 22*a* and 22*b*. As intended for the present invention, this alignment is continued from each subarray 22 to the next adjacent subarray 22. Thus, alignment phase shifter element 50*b* is used to align subarray 22*c* with subarray 22*b*, and alignment phase shifter element 50*c* is used to align subarray 22*d* with subarray 22*c*. This, of course, can be continued on for as many subarrays 22 as there are in the radar 10.

The transmission line, phase shifter elements in the phase shifter subarrays, the alignment phase shifters and coils of the phase shifter assembly can all be formed as printed circuits.

Actual control of the alignment phase shifter elements 50 a–c is accomplished in a manner similar to that disclosed above in conjunction with the discussion of FIG. 3 for control of the individual phase shifter elements 26 in each subarray 22. Specifically, each of the alignment phase shifter elements 50 a–c is disposed on the ferri-magnetic substrate 24, and each is influenced by the magnetic flux which can be generated by a respectively associated coil 52 a–c. As shown, each of the coils 52 a–c is established by a line 54 which electrically connects all of the coils 52 a–c in series with a Drive (B) 56. Through this connection, current from the Drive (B) 56 can establish flux fields for each of the alignment phase shifter elements 50, and depending on the particular adjustment given to each of the alignment phase shifter elements 50, these elements 50 can be used to align the various subarrays 22 to establish a constant and continuous wave front for the antenna 30.

In the operation of the radar 10 of the present invention, it is important to mitigate, if not eliminate, the adverse effects of system irregularities. It happens that, because components are connected serially, the unavoidable setting inaccuracies and the attenuation of the phase shifter elements, both elements 26 and elements 50, are additive. The largest single inaccuracy, however, is thermal induced deviation. Fortunately, these inaccuracies are somewhat predictable and can, therefore, be compensated. For the present invention, this compensation is done primarily with preprogrammed microprocessors.

Figure 4:
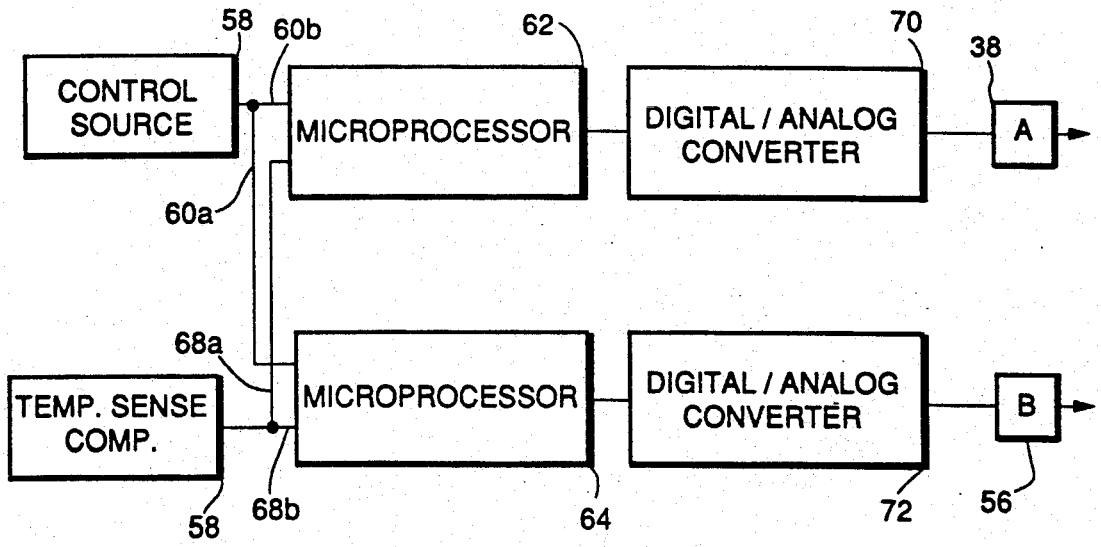
FIG. 4 is a schematic diagram of the control componentry of the present invention.

FIG. 4 shows a schematic diagram of the control components for the radar 10 As shown, these include a control source 58 where the control parameters such as beam strength, sweep time, angle of sweep and other physical characteristics of the system performance are established. The digital signals representing these parameters are sent respectively via lines 60*b* and 60*a* to separate microprocessors 62 and 64. As contemplated for the present invention, the microprocessors 62 and 64 are preferably of a type known in the pertinent art as an EA-PROM.

FIG. 4 also shows that a temperature sensing component 66 is employed to detect thermal deviations at critical points in the system. Digital signals representing these temperature deviations, like the control parameter signals, are also sent to the microprocessors 62 and 64. In this case the signals are sent from temperature sensing component 66 to the microprocessors 62 and 64 via lines 68*a* and 68*b*, respectively. In accordance with the proper programming of the microprocessor 62, information from both control source 58 and temperature sensing component 66, are used as input for Drive (A) 38. More specifically, the digital signals are changed at converter 70 into analog signals, and these analog signals are then used as input to Drive (A) 38. As disclosed above, Drive (A) 38 is used in radar 10 to operate the subarrays 22 for directing the beam 14. Similarly, with the proper programming of the microprocessor 64, information from both control source 58 and temperature sensing component 66, are used as input for Drive (B) 56. Again, the digital signals are changed into analog signals, this time by converter 72, and the resultant analog signals are used as input to Drive (B) 56. As disclosed above, Drive (B) 56 is used in radar 10 to operate the alignment phase shifters 50 a–c for the purposes of aligning the subarrays 22 so that the antenna 30 will generate a substantially continuous wave.

A particularly helpful design feature of the present invention is that once the microprocessors 62 and 64 have been programmed for the system level design, it is a relatively simple matter to accomplish their final calibration and alignment as a last step of production. This can be done after final assembly of the system has been completed.

While the particular phase shifter assembly for use with a phased array antenna to direct a radiated beam as herein shown and disclosed in detail is fully capable of obtaining the objects and providing the advantages herein before stated, it is to be understood that it is merely illustrative of the presently preferred embodiments of the invention and that no limitations are intended to the details of the construction or design herein shown other than as defined in the appended claims.

We claim:

1. A phase shifter assembly for use with a phased array antenna to direct a radiated beam which comprises:

a ferri-magnetic substrate;

a plurality of phase shifter subarrays, each said subarray having a plurality of phase shifter elements mounted on said substrate and a coil disposed on said substrate for inducing a flux field in said substrate to differentially influence each said phase shifter element in said subarray;

a transmission line for connecting a common power feed in series with said plurality of subarrays;

a plurality of alignment phase shifters, a single said alignment phase shifter being connected into said transmission line between adjacent subarrays to establish phase alignment between said adjacent subarrays to create a continuous wave for said radiated beam; and a common driver connected in series with each said coil to influence said phase shifter elements in each said subarray to direct said radiated beam from said antenna.

2. A phase shifter assembly as recited in claim 1 further comprising a plurality of power splitters/combiners connected in series along said transmission line, each said subarray being connect to said transmission line through one said power splitter/combiner.

3. A phase shifter assembly as recited in claim 2 further comprising a plurality of serially connected alignment coils, each said alignment coil being mounted on said substrate to influence one of said alignment phase shifters.

4. A phase shifter assembly as recited in claim 3 further comprising a driver connected in series with said plurality of alignment coils.

5. A phase shifter assembly as recited in claim 4 wherein said plurality of power splitter/combiners are tailored to compensate for attenuation of each said subarray to establish a substantially optimal shape for said directed beam.

6. A phase shifter assembly as recited in claim 4 further comprising a microprocessor connected to said driver for said phase shifter elements in each said subarray to control activation of said flux field for each said subarray and to compensate for physical irregularities in said substrate.

7. A phase shifter assembly as recited in claim 4 further comprising a microprocessor connect to said driver for said plurality of alignment coils to obtain phase alignment between said adjacent subarrays and to compensate for physical irregularities in said substrate.

8. A phase shifter assembly as recited in claim 4 wherein said transmission line, said phase shifter elements in said phase shifter subarrays, said alignment phase shifters, and said coils are printed circuits.

9. A phase shifter assembly for use with a phased array antenna to direct a radiated beam which comprises:

means for serially transmitting power to a plurality of phase shifter subarrays for radiating a signal from each said subarray;

means connected in series with said plurality of subarrays for shifting phases in said power at each said subarray to direct said signal from each said individual subarray into said beam; and means for collectively aligning each said subarray with said other subarrays in said phase shifter to generate a substantially continuous wave for said beam.

10. A phase shifter assembly as recited in claim 9 wherein said power transmitting means comprises a power feed and a transmission line connecting said common power feed in series with said subarrays.

11. A phase shifter assembly as recited in claim 10 further comprising a common driver for said subarrays and wherein said means for shifting phases in said power at each said subarray comprises:

a ferri-magnetic substrate;

a plurality of phase shifter elements mounted on said substrate; and a coil disposed on said substrate in series with said driver for inducing a flux field in said substrate to differentially influence each said phase shifter element in said subarray.

12. A phase shifter assembly as recited in claim 11 wherein said aligning means comprises:

a plurality of alignment phase shifters, with a single said alignment phase shifter being connected into said transmission line between adjacent subarrays;

a plurality of serially connected alignment coils, each said alignment coil being mounted on said substrate to influence one of said alignment phase shifters; and a driver connected in series with said plurality of alignment coils to establish phase alignment between said adjacent subarrays and create a substantially continuous wave for said radiated beam.

13. A phase shifter assembly as recited in claim 12 further comprising a plurality of power splitters/combiners connected in series along said transmission line, each said subarray being connected to said transmission line through one said power splitter/combiner and wherein said plurality of power splitter/combiners are tailored to compensate for attenuation of each said subarray to establish a substantially optimal shape for said directed beam.

14. A phase shifter assembly as recited in claim 13 further comprising a microprocessor connected to said driver for said phase shifter elements in each said subarray to control activation of said flux field for each said subarray and to compensate for physical irregularities in said substrate.

15. A phase shifter assembly as recited in claim 13 further comprising a microprocessor connect to said driver for said plurality of alignment coils to obtain phase alignment between said adjacent subarrays and to compensate for physical irregularities in said substrate.

16. A phase shifter assembly as recited in claim 13 wherein said transmission line, said phase shifter elements in said phase shifter subarrays, said alignment phase shifters, and said coils are printed circuits.

* * * * *